US008528484B2

(12) United States Patent
Helmick

(10) Patent No.: US 8,528,484 B2
(45) Date of Patent: Sep. 10, 2013

(54) RAILROAD TIE PLATE APPARATUS AND METHOD

(75) Inventor: Stoney L. Helmick, Coxs Mills, WV (US)

(73) Assignee: H & H Railroad Contracting, Inc., Cox Mills, WV (US)

( * ) Notice: Subject to any disclaimer, the term of this patent is extended or adjusted under 35 U.S.C. 154(b) by 0 days.

(21) Appl. No.: 13/418,258

(22) Filed: Mar. 12, 2012

(65) Prior Publication Data

US 2012/0204752 A1 Aug. 16, 2012

Related U.S. Application Data

(63) Continuation-in-part of application No. 12/416,565, filed on Apr. 1, 2009, now Pat. No. 8,132,512.

(60) Provisional application No. 61/157,364, filed on Mar. 4, 2009.

(51) Int. Cl.
*E01B 3/00* (2006.01)

(52) U.S. Cl.
USPC ..... 104/16; 104/2

(58) Field of Classification Search
USPC ..... 104/2, 16
See application file for complete search history.

(56) References Cited

U.S. PATENT DOCUMENTS 3,157,267 A * 11/1964 Asbury ..... 198/310
4,168,771 A 9/1979 Krivec
4,211,170 A * 7/1980 Theurer ..... 104/2
4,225,429 A * 9/1980 Holley ..... 209/215
4,280,613 A 7/1981 Stewart
4,576,538 A * 3/1986 Theurer et al. ..... 414/339
4,691,639 A * 9/1987 Holley ..... 104/16
4,733,614 A 3/1988 Mohr et al.
4,770,103 A 9/1988 Allmer
4,942,822 A 7/1990 Cotic
5,067,412 A 11/1991 Theurer et al.
5,090,484 A * 2/1992 Theurer et al. ..... 171/16
5,109,775 A * 5/1992 Kershaw et al. ..... 104/2
5,193,461 A 3/1993 Theurer et al.
5,305,692 A 4/1994 Madison et al.
5,331,899 A 7/1994 Holley
5,419,259 A 5/1995 Theurer et al.
5,722,325 A 3/1998 Glomski et al.
5,839,377 A 11/1998 Brenny et al.
6,170,401 B1 1/2001 Miller et al.
6,595,140 B1 7/2003 Madison et al.
6,807,909 B1 * 10/2004 Coots ..... 104/16
7,827,916 B2 * 11/2010 Coots, Jr. ..... 104/16
2004/0003748 A1 * 1/2004 Theurer et al. ..... 104/2
2006/0045684 A1 * 3/2006 Sperling ..... 414/434
2009/0095188 A1 * 4/2009 Bounds ..... 104/2
2009/0133598 A1 * 5/2009 Coots, Jr. ..... 104/2

(Continued)

*Primary Examiner* — Jason C Smith
(74) *Attorney, Agent, or Firm* — Birch, Stewart, Kolasch & Birch, LLP

(57) ABSTRACT

A cleated belt conveyor is positioned atop a frame connected to a hi-rail truck. The cleated belt conveyor is operably connected to a railroad engagement wheel positioned under the frame to coordinate movement of the cleated belt conveyor relative to the railroad engagement wheel. A sliding member can be positioned at the top, or infeed end, of the cleated belt conveyor for receiving railroad tie plates from an infeed conveyor. One or more sets of rollers can be positioned at the bottom of the cleated belt conveyor for distributing the tie plates near a rail in a desired orientation.

10 Claims, 8 Drawing Sheets

(56) References Cited

U.S. PATENT DOCUMENTS

2010/0132582 A1* 6/2010 Theurer et al. ..... 104/2
2010/0224096 A1* 9/2010 Helmick ..... 104/2
2012/0204752 A1* 8/2012 Helmick ..... 104/16

* cited by examiner

RAILROAD TIE PLATE APPARATUS AND METHOD

CROSS REFERENCE TO RELATED APPLICATIONS

This application is a continuation-in-part of U.S. patent application Ser. No. 12/416,565, filed Apr. 1, 2009, which claims the benefit of U.S. patent application No. 61/157,364 filed Mar. 4, 2009.

FIELD OF INVENTION

The present application relates to railroad tracks, and more particularly to an apparatus and method for distributing railroad tie plates adjacent to the rails of railroad tracks.

BACKGROUND

The rails of a railroad track are usually secured to cross ties by spikes driven into tie plates, with the tie plates located between the rail and the tie, and the head of the spike overlapping the bottom of the rail. The tie plates block lateral movement of the rails. Anchors are attached to the rail on either side of the tie to secure the rail against longitudinal movement.

Railroad ties occasionally must be replaced due to wear. After a tie is replaced, tie plates must be provided between the rail and the tie so that the rail may be properly secured to the tie.

Several references propose various systems for use in replacing tie plates. For example, U.S. Pat. No. 4,280,613, issued to J. K. Stewart on Jul. 28, 1981, describes a tie plate conveying and orienting system.

U.S. Pat. No. 4,770,103, issued to F. Allmer on Sep. 13, 1988, describes a rail clamp. The rail clamp includes a pair of line-up wheels for engaging the inside edges of the rails. A pair of pivoting clamping arms, with each clamping arm having a disk rotatably mounted to its end, engages the outside edge of each rail, just below the rail's ball. Movement of the clamping arms is controlled by hydraulic cylinders. Additionally, a stabilizer cylinder connecting a bridge crossing the chassis to the rail lifting assembly may either permit the rail lifting assembly to float to correspond with the rails, or may be locked in position.

U.S. Pat. No. 4,733,614, issued to G. Mohr et al. on Mar. 29, 1988, describes a machine for repairing a railway track. The machine includes a main chassis having various devices for repairing a railway, mounted on a chain drive under a railway vehicle. A counter weight mounted to the chain drive, moving the opposite direction, counters the effects of inertia.

U.S. Pat. No. 4,942,822, issued to D. J. Cotic on Jul. 24, 1990, describes an apparatus and method for automatically setting rail tie plates. The apparatus includes a frame having a ramp thereon. The ramp stores the tie plates, and includes a control mechanism for releasing them one at a time into a plate pocket. A reciprocated pusher then moves the plate from the plate pocket to its position on the tie.

U.S. Pat. No. 5,067,412, issued to J. Theurer et al. on Nov. 26, 1991, describes a tie plate-inserting machine. The front of the machine includes a crane broom with a tie plate-collecting magnet. A funnel adjacent to the crane leads to a conveyer, which terminates above a sorting table. A roller conveyer conveys ties from the sorter to a magazine. The magazine moves between a level position for receiving tie plates from the sorting table, and a lower position for dispensing the tie. The machine includes a tie plate-inserting arm slidably supported by a guide rod, for pushing the—tie plates from the magazine to their position below the rail. A lifting roller pivots between a raised position and a lowered position for permitting tie plates to be pushed thereon from the magazine to their final position below the rail.

U.S. Pat. No. 5,193,461, issued to J. Theurer et al. on Mar. 16, 1993, describes a tie exchange means for both removing ties and inserting new ties. The tie exchange machine may move longitudinally along a guide track. A scarifier and track-lifting device are included. A mobile tie transporting crane may move towards or away from the tie exchange device, for transporting either new ties to be installed or old ties which have been removed. The tie-depositing device is a vertically adjustable forklift.

U.S. Pat. No. 5,305,692, issued to H. Madison et al. on Apr. 26, 1994, and assigned to Harsco Corporation, describes a tie exchanger mounted on a truck. The tie exchanger has a rail clamp table having rail clamps and a boom. The boom includes a tie clamp, and may pivot around the vertical axis to insert ties from either side of the tracks.

U.S. Pat. No. 5,331,899, issued to J. D. Holley on Jul. 26, 1994, describes a tie plate installer and remover using a magnetic wheel to insert or remove a tie plate. The tie plate installer includes a tie magazine from which tie plates are dropped into a shoot leading to the magnetic wheel, which then carries the tie plate to a position on the tie adjacent to its final location under the rail, and finally pushes it under the rail.

U.S. Pat. No. 5,419,259, issued to J. Theurer et al. on May 30, 1995, describes a ballast stabilizer. The ballast stabilizer has a rail clamp including a roller for engaging the rail's ball, mounted on an arm secured at its other end to a lever. The opposite arm of the lever is secured to a hydraulic cylinder, so that extending the cylinder pushes inward on the clamp arm. A pair of vertical inner wheels are pushed against the gauge side of the rail's ball by hydraulic cylinders. A shaking apparatus vibrates the machine parallel to the ties.

U.S. Pat. No. 5,722,325, issued to K. E. Glomski et al. on Mar. 3, 1998, describes a tie replacement apparatus including drip elements for holding a tie plate in place while the tie underneath is replaced.

U.S. Pat. No. 5,839,377, issued to D. M. Brenny et al. on Nov. 24, 1998, describes a machine for installing and removing elastic rail clips of the type used for fastening rails to concrete or wooden ties.

U.S. Pat. No. 6,170,401, issued to R. Miller et al. on Jan. 9, 2001, describes a rail vehicle for collection and distribution of railroad cross ties.

When replacing tie plates, it is useful to position the tie plates near the section of track where the plates will be used to secure the rail to the ties. More specifically, it would be helpful to be able to automatically or semi-automatically place a tie plate at the respective ends of a railroad tie to which a section of rail is going to be attached. Furthermore, it is desirable to be able to easily manipulate and move an apparatus which could automate the tie-placement system and to tie such an apparatus into an existing hi-rail truck or other rail-vehicle system. Accordingly, a railway tie placement apparatus and method incorporating these features is desired.

SUMMARY

The present application teaches an apparatus and method for depositing railroad tie plates adjacent both rails of a set of railroad tracks simultaneously or nearly simultaneously. The application teaches parallel cleated belt conveyors timed relative to the rate of rotation of one or more railroad engagement wheels under a frame between the conveyors to ensure proper spacing between the tie plates along the length of rail. Sliding members positioned above the upper end of the conveyors help transfer the tie plates from an optional infeed conveyor to the cleated belt conveyors.

In an alternative embodiment, the application teaches a single cleated belt conveyor positioned between a sliding member at its top end for receiving railroad tie plates from an infeed source, and one or more sets of rollers at its bottom end for depositing the tie plates along the rails of a railroad track. The optional rollers are used to prevent the tie plates from flipping over as they are falling to the ground and to assure the tie plates are distributed with the desired side up. Also, the rollers advantageously accommodate tie plates of different sizes, shapes, configurations, in contrast to tie plate distribution machines that pinch or grab the tie plates at the bottom of the conveyor prior to distribution. The cleats on the cleated belt conveyor are synced with one or more railroad engagement wheels and a drive member to rotate the cleated belt conveyor at a desired speed relative to the space between railroad ties and the desired number of tie plates to be distributed.

BRIEF DESCRIPTION OF THE DRAWINGS

The present invention is described with reference to the accompanying drawings.

DETAILED DESCRIPTION

Figure 1:
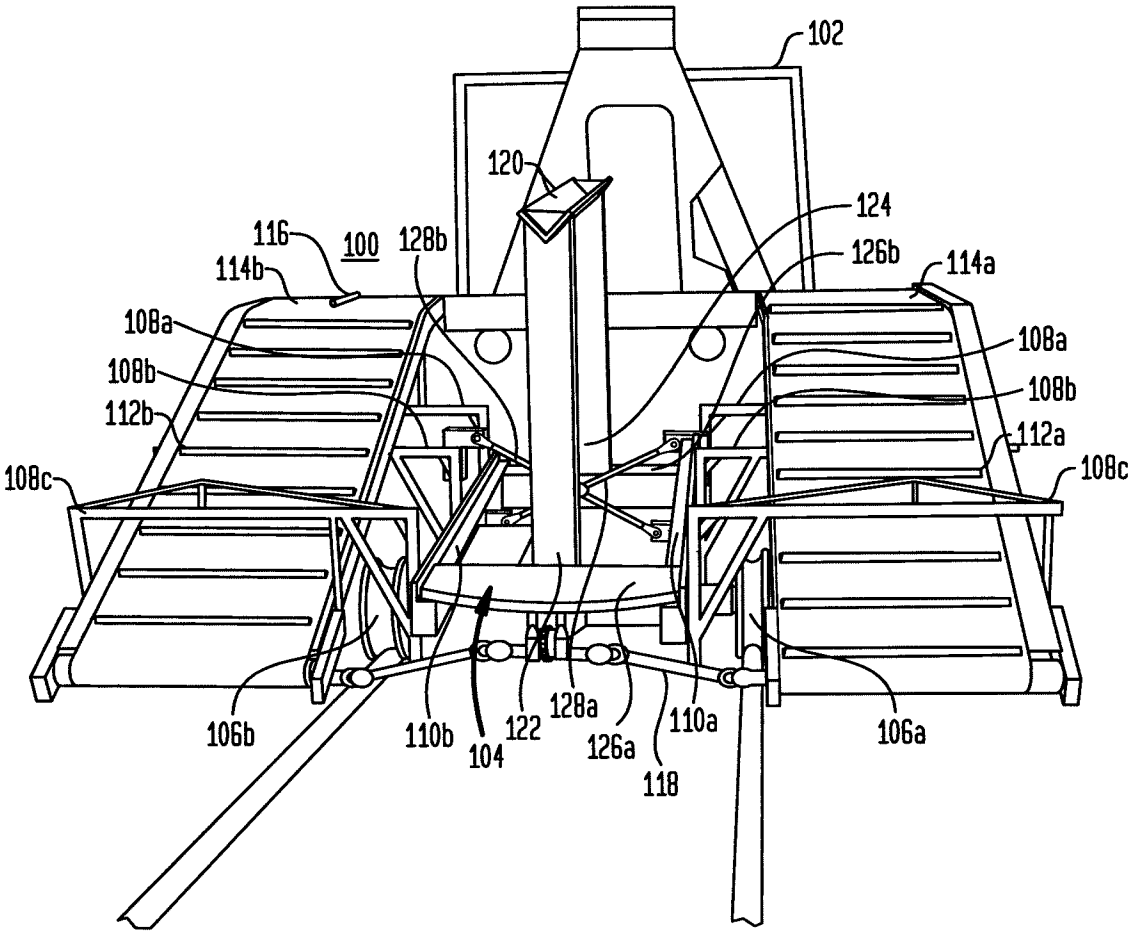
FIG. 1 is a rear view showing most clearly the frame, lifting member, and conveyors in relation to a set of railroad tracks and a hi-rail truck.

According to the present application, an apparatus is described which provides an automatic or semi-automatic conveyor belt system for placing railroad tie plates adjacent the parallel rails of a length of railroad track.

According to one aspect of the invention, the apparatus includes a generally rectangular frame having at least two rail engagement wheels positioned under the frame; two or more connecting members attached to each of the long sides of the frame; two cleated belt conveyors, one attached to each of the long sides of the frame by the connecting members; a towing member extending away from an end of the frame; a sliding member positioned above each of the cleated belt conveyors and having a tie plate guiding member adjustably connected to the sliding member; a drive member connected to and extending between at least one of the railroad engagement wheels and the cleated belt conveyors for controlling the speed at which the cleated belt conveyors operate; and a lifting member extending vertically from the frame, wherein the lifting member has a generally inverted U-shape and a first end of the lifting member is connected at about a mid-point of a first short side of the frame and a second end of the lifting member is connected at about a mid-point of a second short side of the frame.

A second aspect of the invention is an apparatus having first and second conveyors positioned along opposite sides of a frame positioned about centrally between the first and second conveyors; wherein the first and second conveyors are operably connected to a railroad engagement wheel positioned under the frame to coordinate movement of the first and second conveyors relative to the railroad engagement wheel.

A third aspect of the invention is a method of placing railroad tie plates alongside a rail by alternately feeding railroad tie plates to first and second sliding members, wherein a first sliding member is positioned above a first conveyor belt and a second sliding member is positioned above a second conveyor belt, further wherein the first and second conveyors are positioned along opposite sides of a frame positioned about centrally between the first and second conveyors and the first and second conveyors are operably connected to a railroad engagement wheel positioned under the frame to coordinate movement of the first and second conveyors relative to the railroad engagement wheel; and sliding the railroad tie plates along the sliding member and onto one of the conveyor belts.

A fourth aspect of the invention is an apparatus including a frame member positioned above and connected to two or more railroad engagement wheels; a cleated belt conveyor having a top and a bottom and being positioned on the frame and angled downwardly for depositing railroad tie plates along railroad ties on a railroad track; a set of rollers connected to the frame and positioned at the bottom of the cleated belt conveyor; a towing member connected to and extending away from an end of the frame; a sliding member positioned above the cleated belt conveyor, wherein the sliding member has a top surface; a drive means for mechanically linking at least one of the railroad engagement wheels and the cleated belt conveyor for controlling the speed at which the cleated belt conveyor rotates; and a lifting member extending vertically from the frame, wherein the lifting member has a generally inverted U-shape.

One specific application of this apparatus and system involves integration with a hi-rail truck or other similar rail vehicle adapted to feed railroad tie plates to the apparatus for automatic or semi-automatic placement of the tie plates alongside a length of railroad track and more specifically outside the respective parallel rails of the track and adjacent the ends of the railroad ties. The hi-rail truck can include an infeed conveyor for transporting the tie-plates from the bed of the truck to the cleated belt conveyors.

The preferred embodiment will be described with reference to FIG. 1, which shows an exemplary apparatus 100 of the present invention integrated with a hi-rail truck 102. The apparatus 100 comprises a generally rectangular frame 104 having at least two rail engagement wheels 106*a*, 106*b* positioned under the frame 104. Two or more connecting members 108*a-c* are attached to each of the long sides 110*a*, 110*b* of the frame 104. Two cleated belt conveyors 112*a*, 112*b* are attached to the long sides 110*a*, 110*b* of the frame 104 by the connecting members 108*a-c*. A towing member 202 extends away from an end 204 of the frame 104. A sliding member 114*a*, 114*b* is positioned above each of the cleated belt conveyors 112*a*, 112*b* and having a tie plate guiding member 116 adjustably connected to the sliding member 114*a* or 114*b*. A drive member 118 can be connected to and extend between at least one of the railroad engagement wheels 106*a* or 106*b* and the cleated belt conveyors 112*a*, 112*b* for controlling the speed at which the cleated belt conveyors 112*a*, 112*b* operate. A lifting member 120 can extend vertically from the frame 104, wherein the lifting member 120 has a generally inverted U-shape and a first end 122 of the lifting member 120 is connected at about a mid-point of a first short side 126*a* of the frame 104 and a second end 124 of the lifting member 120 is connected at about a mid-point of a second short side 126*b* of the frame 104. Conveyor belt 112*a,b* raising and lowering means 128*a*, 128*b* can be included to raise and lower the cleated belt conveyors 112*a*, 112*b*.

Figure 2:
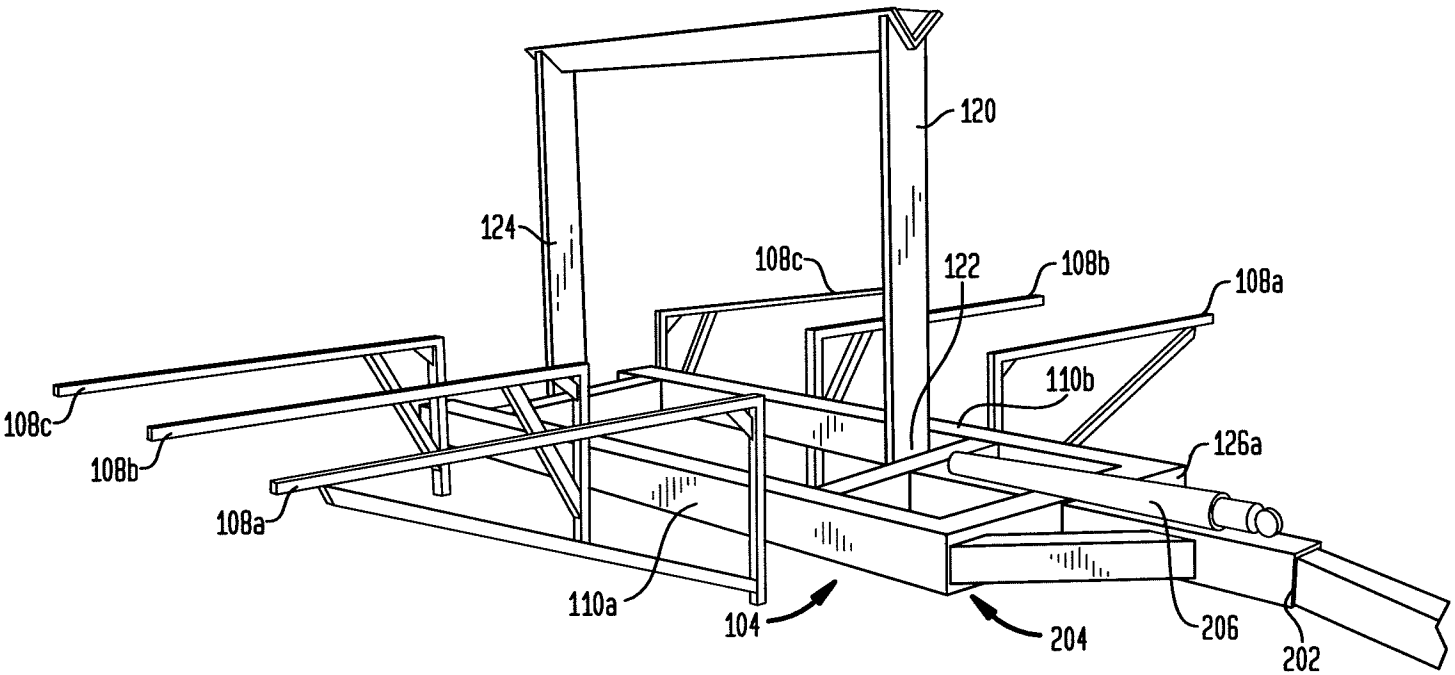
FIG. 2 shows the frame, lifting member, and connecting members without the conveyor belts.

As shown more clearly in FIG. 2, the frame 104 is generally rectangular in shape with two long sides 110*a*, 110*b* and two short sides 126*a*, 126*b*. A lifting member 120 is in the shape of an inverted U with a first end 122 of the lifting member 120 connected at about a mid-point of a first short side 126*a* of the frame 104 and a second end 124 of the lifting member 120 connected at about a mid-point of a second short side 126*b* of the frame 104. The apparatus 100 preferably includes three connecting members 108*a-c* connected to each of the long sides 110*a,b* of the frame 104. The connecting members 108*a-c* can be trianglular-shaped with a short side of the triangles connected to the outside edge of the long sides 110*a,b* of the frame 104. A towing member 202 extends from one of the short sides 126*a* or 126*b* of the frame 104. The towing member 202 preferably is extendable and includes a means for extending and retracting the towing member. A preferred extending and retracting means is a cylinder 206 for extending and retracting the towing member 202, which can be used to connect the frame 104 of the apparatus 100 to a hi-rail truck 102 or other vehicle for transporting the apparatus 100 along a railroad track.

Figure 3:
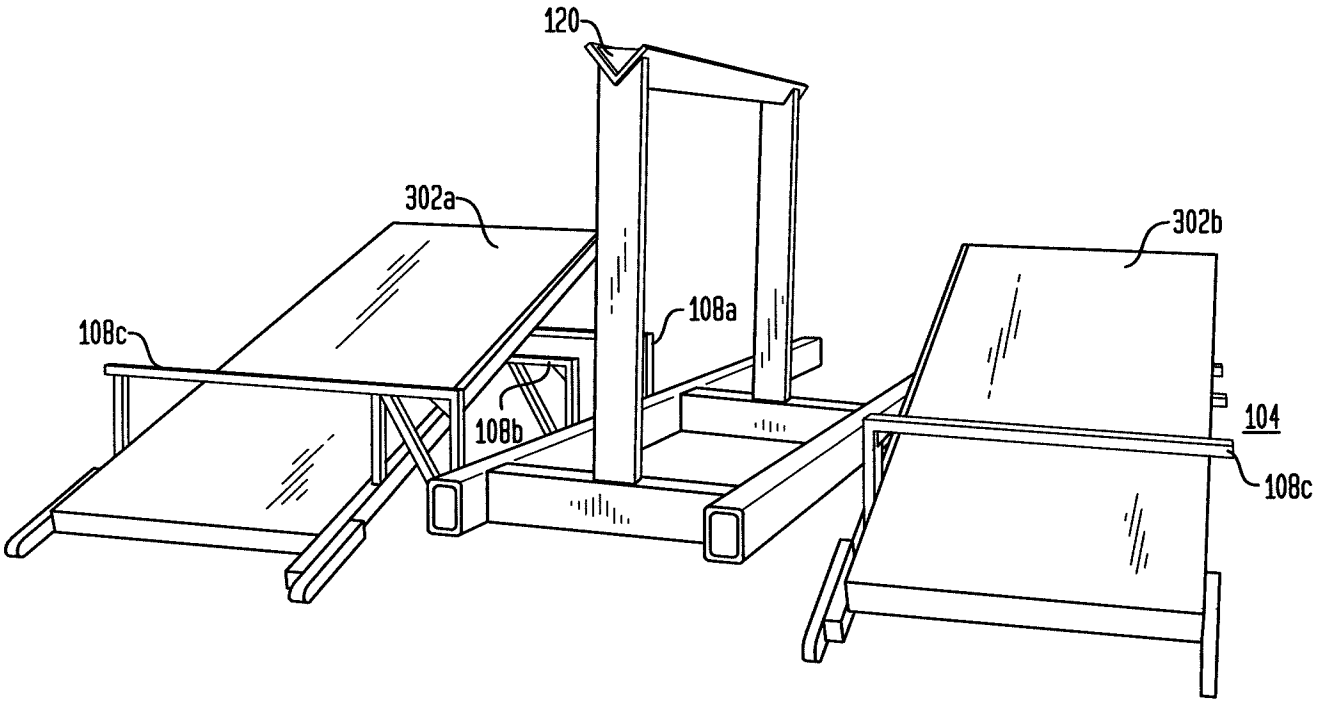
FIG. 3 shows the conveyor belts being placed on the connecting members of the apparatus from FIG. 2.

FIG. 3 shows the frame 104 of FIG. 2 with conveyor belt support members 302*a* and 302*b* attached to the connecting members 108*a-c*. The connecting members 108*b* can extend through a first side of a conveyor belt support member 302*a,b* and cross underneath the width of the conveyor belt support members 302*a,b* and be secured to a second side of the conveyor belt support member 302*a,b*. The connecting member 108*a* and 108*c* include additional bracketry for connecting the connecting members 108*a* and 108*c* to the conveyor belt support members 302*a,b*.

Figure 4:
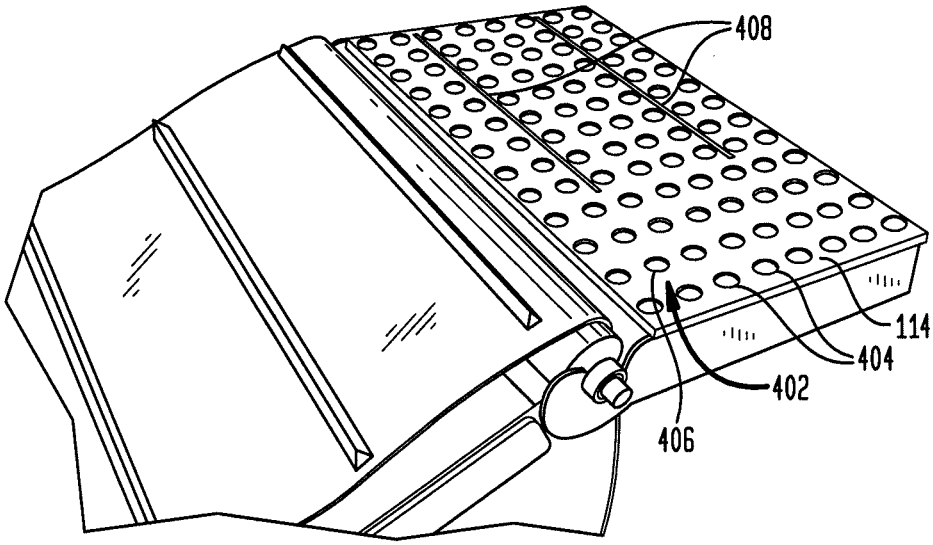
FIG. 4 shows a close-up view of a sliding member at the top of a conveyor belt.

FIG. 4 shows a sliding member 114 positioned above a cleated belt conveyor 112. The sliding member 112 has a top surface 402 and includes a plurality of ball bearings 404 embedded in the sliding member 112 and projecting above the top surface 402 of the sliding member 112. Each ball bearing 404 is contained within an opening 406 in the top surface 402 of the sliding member 112, but the ball bearings 404 rotate freely within the openings 406 thereby creating a suface over which the tie plates can be slid with little manual effort. The sliding member 114 includes two guide troughs 408 for receiving a tie plate guiding member 116. The position of the tie plate guiding member 116 on the sliding member 114 can be adjusted by moving the sliding member 114 along the guide troughs 408 and securing the guiding member 116 in place by inserting a screw through the guiding member 116 and the guide troughs 408 and locking it in place with a nut.

Figure 5:
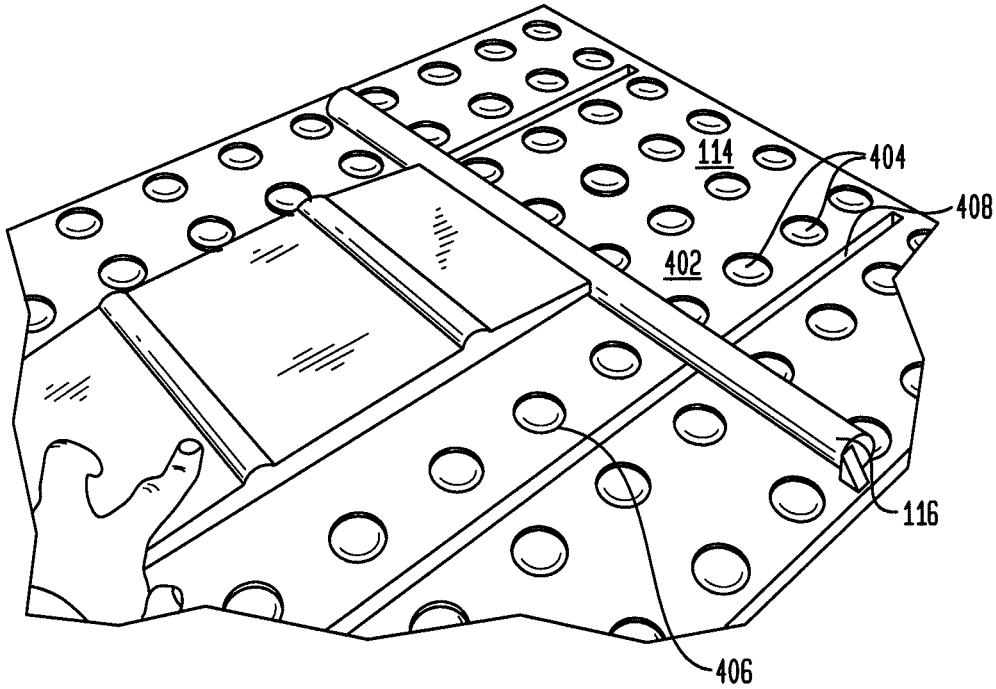
FIG. 5 shows a close up of a guiding member adjustably positioned on the top surface of a sliding member.

As shown in FIG. 5, the position of the guiding member 116 on the sliding member 114 can be adjusted to accommodate different size tie plates and also can be adjusted depending on the desired placement of the tie plate on the conveyor belt 112. For example, the width of conveyor belt 112 can be about two times the width of the tie plates and thus the tie plates can be positioned on the inside or outside half of the conveyor belt 112. As a result, the tie plates can be dropped either closer to or further away from the railroad track rails depending on the placement of the tie plates on the conveyor belts 112. The tie plates can be slid across the sliding member 114 up to and against the guiding member 116 which stops the lateral movement of the tie plates. The tie plates can then be re-directed perpendicularly by sliding the tie plates on the sliding member 114 towards the conveyor belts 112.

Figure 6:
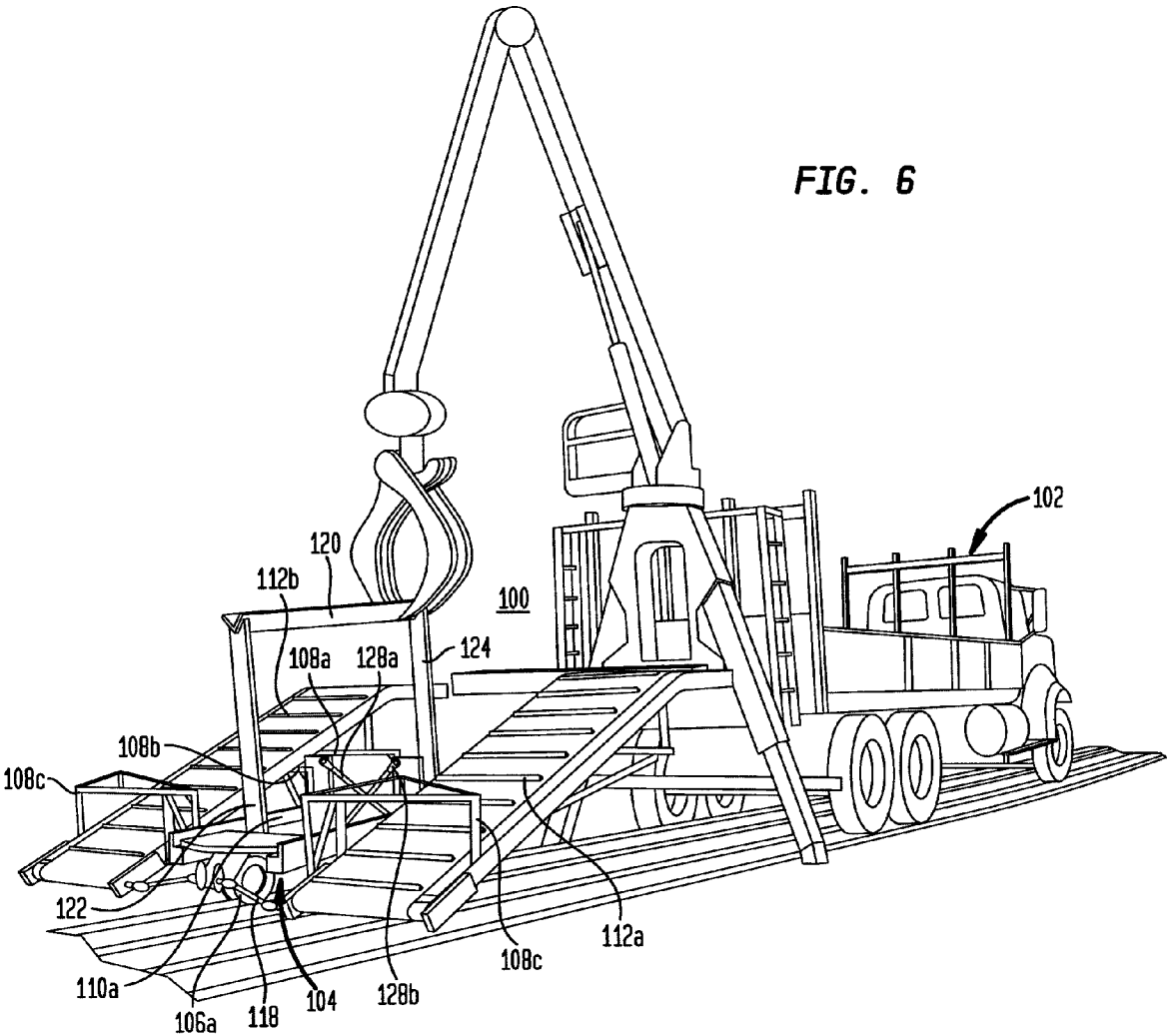
FIG. 6 shows use of the lifting member to position the apparatus behind a hi-rail truck.

FIG. 6 shows an apparatus 100 of the present invention being integrated with a hi-rail truck 102. The lifting member 102 provides a means for moving the apparatus 100 and placing it in a desired position. For ease of transport, the apparatus 100 can include conveyor belt 112 raising and lowering means 128*a,b* for raising the conveyor belts 112*a,b* and rotating them inward to reduce the footprint of the apparatus 100. Once in position on the track, the belts 112*a,b* can be rotated outward and down. The preferred raising and lowering means 128*a,b* is one or more hydraulic cylinders connected to the connecting members 108*b* that extend from the conveyor belts 112*a,b* to the frame 104.

The hi-rail truck 102 can include an infeed conveyor which transports tie plates from the bed of the truck to a sliding member 114 positioned between the top end of the conveyors 112*a,b*. The tie plates can be re-directed to either of the conveyor belts 112*a,b* by sliding the tie plate across the freely-rotating ball bearings 404 embedded in the sliding members 114. The lateral movement of the tie plates is stopped when the tie plates come into contact with the guiding members 116 situated on the top surface 402 of the sliding members 114, which are positioned above the top end of the conveyor belts 112*a,b*. The tie plates are once again re-directed, this time toward the downwardly projecting conveyor belts 112*a,b*, by sliding the tie plates perpendicularly on the sliding member 114.

The tie plates are positioned on the cleated belt conveyors 112*a,b* either further inside toward the rail or further outside further away from the rail depending on the positioning of the guiding member 116 on the sliding member 114. The cleated belt on the conveyor 112 keeps the tie plates in position and aligned and delivers the tie plates to the ground adjacent the rail. A drive member 118 is connected to the rail engagement wheels 106*a,b* and extends to a drive shaft on the conveyor belts 112*a,b*. The drive member 118 times the movement of the conveyors 112*a,b* with the railroad engagement wheels 106*a,b* so the tie plates are dropped to the ground adjacent the rails at desired intervals. Alternate gearing can be used to adjust the timing of the conveyor belt 112 rotation relative to the rotation of the railroad engagement wheels 106*a,b* depending on the desired spacing between tie plates adjacent the rail.

Figure 7:
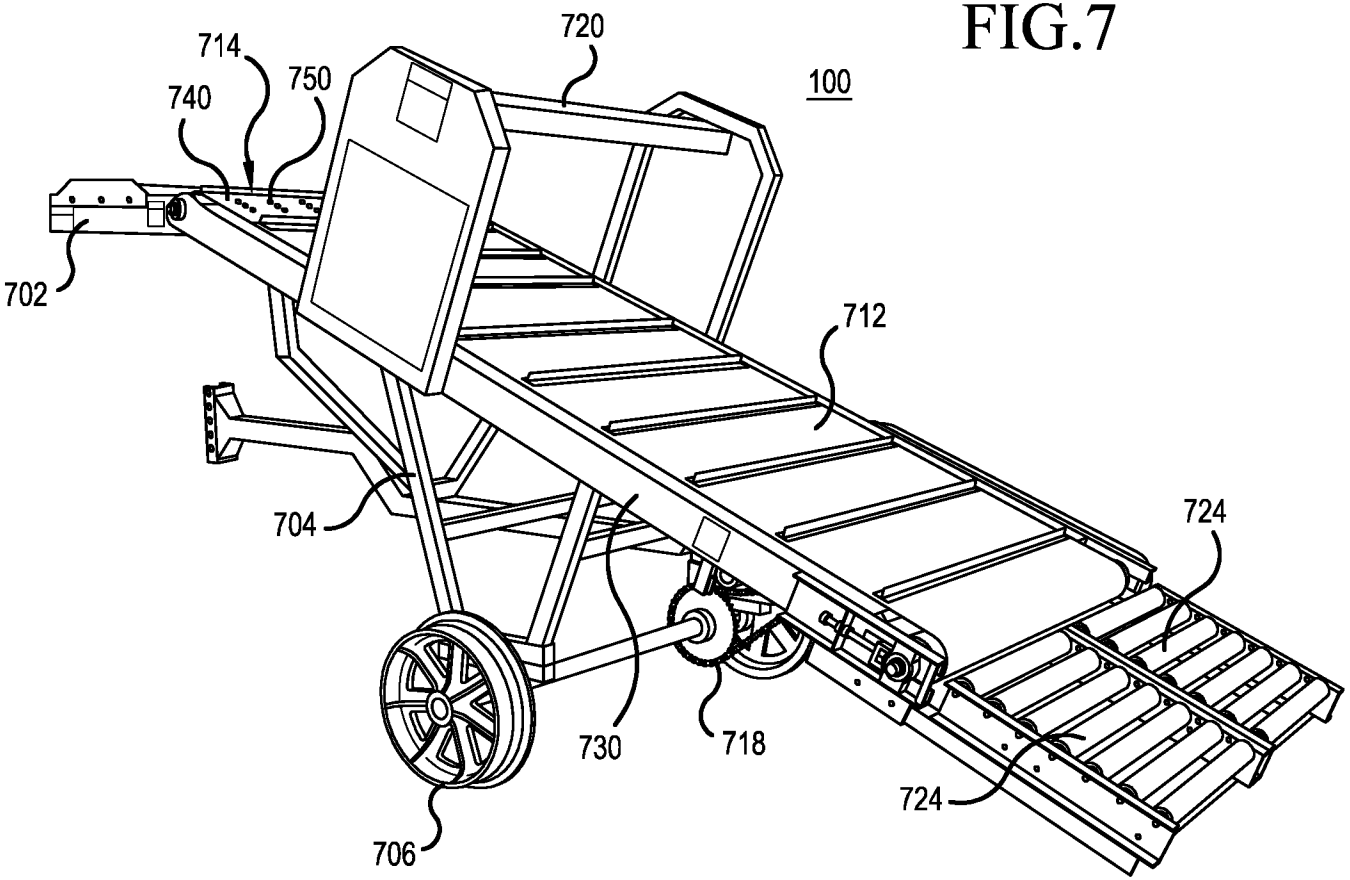
FIG. 7 shows an alternative embodiment of the invention with a single cleated belt conveyor for use in the middle of a set of railroad tracks.
Figure 8:
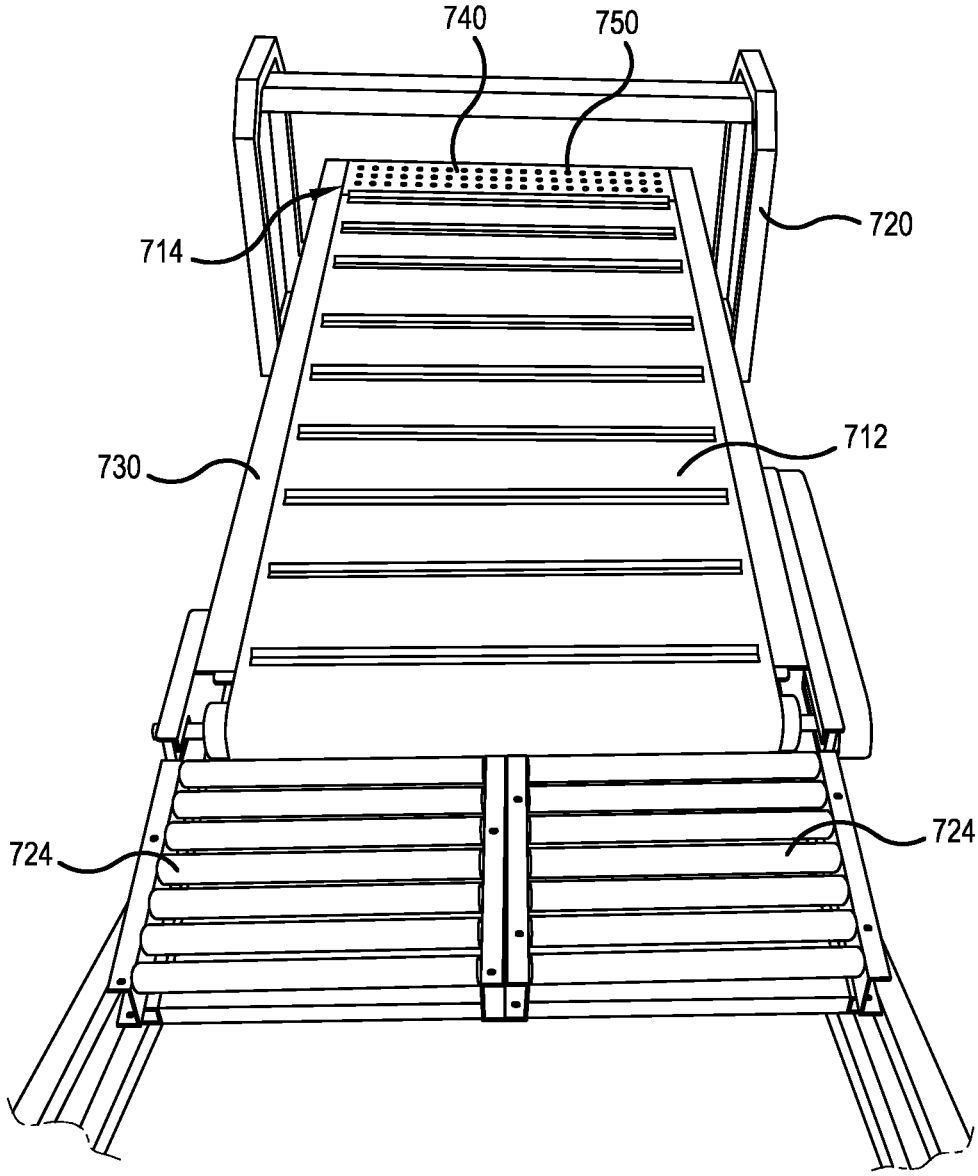
FIG. 8 is a side view of the alternative embodiment of FIG. 7.

FIGS. 7 and 8 show an alternative embodiment of the apparatus 100 having a single cleated belt conveyor 712, which preferably is positioned in the middle of a set of rails during operation. As with the other embodiments, cleated belt conveyor 712 is adapted for use with a hi-rail truck 102. A conveyor belt support member 730 is secured to a frame 704, which in turn is positioned above and connected to two or more railroad engagement wheels 706*a,b*. A towing member 702 can be connected to and extend away from an end of the frame 704 and towards the hi rail truck 102.

The cleated belt conveyor 712 has a top and a bottom and is positioned atop the support member 730 on the frame 704. The cleated belt conveyor 712 is angled downwardly for depositing railroad tie plates along railroad ties on a railroad track. One or more sets of rollers 724 can be connected to the frame 704 and positioned at the bottom of the cleated belt conveyor 712. The rollers 724 allow for the free fall of the tie plates from the end of the cleated belt conveyor 712 onto the ground near the railroad ties. The tie plates are not constricted at the bottom of the cleated belt conveyor 712 by a wheel or other pinching device prior to distribution. As a result, the apparatus 100 of the present application can be used with tie plates of all sizes, shapes, and orientations regardless of whether the tie plates contain additional features of structure. The rollers 724 also prevent the tie plates from following the cleated belt conveyor 712 around the bottom of the transport loop and flipping over as the tie plates are distributed to the ground. Thus, the rollers 724 can be used or not used depending on whether the user desires for the tie plates to flip over at the bottom of cleated belt conveyor 712 or not.

A sliding member 714 having a top surface 740 can be positioned above the cleated belt conveyor 712. The top surface 740 of the sliding member 714 preferably contains ball bearings 750 positioned in openings on the top surface 740 of the sliding member 740. The sliding member 740 allows for railroad tie plates to be received into the apparatus 100 by means such as an infeed conveyor by simply sliding the tie plates along the top surface 740 of the sliding member 740 and onto the cleated belt conveyor 712.

A drive means 718 mechanically links the one or more railroad engagement wheels 706*a,b* to the cleated belt conveyor 712 for controlling the speed at which the cleated belt 712 rotates relative to the distance between railroad ties. A lifting member 720 having a generally inverted U-shape can extend vertically from the frame 704 to provide an area for grasping the apparatus 100 and moving from job site to job site.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. An apparatus, comprising:

a frame member positioned above and connected to two or more railroad engagement wheels;

a cleated belt conveyor having a top and a bottom and being positioned on the frame and angled downwardly for depositing railroad tie plates along railroad ties on a railroad track;

a set of rollers connected to the frame and positioned at the bottom of the cleated belt conveyor;

a towing member connected to and extending away from an end of the frame;

a sliding member positioned above the cleated belt conveyor, wherein the sliding member has a top surface comprising a plurality of ball bearings embedded in the sliding member such that the ball bearings project above the top surface of the sliding member;

a drive means for mechanically linking at least one of the railroad engagement wheels and the cleated belt conveyor for controlling the speed at which the cleated belt conveyor rotates; and a lifting member extending vertically from the frame above the cleated belt conveyor, wherein the lifting member has a generally inverted U-shape.

2. The apparatus of claim 1, further comprising a tie plate guiding member adjustably positioned on the top surface of the sliding member.

3. The apparatus of claim 1, wherein the cleated belt conveyor has a width adapted for accommodating at least two railroad tie plates positioned side by side on the cleated belt conveyor.

4. The apparatus of claim 1, wherein the cleated belt conveyor comprises cleats that are spaced apart at intervals along a length of the cleated belt conveyor to distribute railroad tie plates at intervals along a railroad track, said intervals being equal or almost equal to a distance between railroad ties along the railroad track.

5. The apparatus of claim 4, wherein the drive means includes gearing having a ratio adjusted to correspond to the space between cleats on the cleated belt conveyor such that the cleated belt conveyor moves at a desired speed relative to the railroad engaging wheels to ensure railroad tie plates are distributed at a desired location along a railroad track.

6. An apparatus, comprising:

a cleated belt conveyor having a top and a bottom and being positioned along a top side of a frame, wherein the cleated belt conveyor is operably connected to a railroad engagement wheel positioned under the frame to coordinate movement of the cleated belt conveyor relative to the railroad engagement wheel;

two or more sets of rollers positioned at a bottom end of the cleated belt conveyor for receiving two or more railroad tie plates to be distributed side by side along a railroad track; and a hi-rail truck adapted for use with the cleated belt conveyor.

7. The apparatus of claim 6, further comprising a towing member connected to and extending away from an end of the frame.

8. The apparatus of claim 6, further comprising a sliding member positioned at the top of the cleated belt conveyor.

9. A method of placing railroad tie plates alongside a rail, comprising:

feeding railroad tie plates to a sliding member, wherein the sliding member is positioned above a cleated belt conveyor, said cleated belt conveyor having cleats that are spaced apart at intervals along a length of the cleated belt conveyor, said cleated belt conveyor further positioned above one or more sets of rollers positioned beneath the cleated belt conveyor to distribute railroad tie plates at intervals along a railroad track, said intervals being equal or almost equal to a distance between railroad ties along the railroad track, and further wherein the cleated belt conveyor is operably connected to a railroad engagement wheel positioned under a frame to coordinate movement of the cleated belt conveyor relative to the railroad engagement wheel; and sliding the railroad tie plates along the sliding member and onto the cleated belt conveyor.

10. The method of claim 9, further comprising adjusting a guiding member positioned along a top surface of the sliding member depending on where the tie plate is to be dropped relative to the rail.

* * * * *